United States Patent [19]

Schneider et al.

[11] Patent Number: 5,041,122

[45] Date of Patent: Aug. 20, 1991

[54] DEPILATION APPARATUS

[75] Inventors: Norbert Schneider, Ebental; Johann Unteregger, Brückl, both of Austria

[73] Assignee: U.S. Philips Corp., New York, N.Y.

[21] Appl. No.: 359,465

[22] Filed: May 31, 1989

[30] Foreign Application Priority Data

Feb. 10, 1989 [AT] Austria ..... 289/89

[51] Int. Cl.[5] ..... A61B 17/50

[52] U.S. Cl. ..... 606/133; A61B/17/50

[58] Field of Search ..... 128/355; 17/11.1 R, 17/47; 132/73, 73.6; 606/131, 133

[56] References Cited

U.S. PATENT DOCUMENTS

| | | | |
|---|---|---|---|
| 1,218,174 | 3/1917 | Faint | 17/11.1 R |
| 2,112,230 | 3/1938 | Fisher | 17/11.1 R |
| 2,900,661 | 3/1957 | Schnell . | |
| 4,279,253 | 7/1981 | Haes et al. . | |
| 4,811,458 | 3/1989 | v.d. Neuwelaar et al. | 17/11.1 R |

FOREIGN PATENT DOCUMENTS

| | | | |
|---|---|---|---|
| 0245141 | 3/1987 | European Pat. Off. . | |
| 2079667 | 10/1971 | France . | |
| 2307492 | 12/1976 | France . | |
| 0652899 | 12/1985 | Switzerland | 128/355 |

*Primary Examiner*—C. Fred Rosenbaum
*Assistant Examiner*—William W. Lewis
*Attorney, Agent, or Firm*—Ernestine C. Bartlett

[57] ABSTRACT

A depilation apparatus is provided comprising at least one pair of circumferentially cooperating depilation rollers (3, 4, 5, 6) which are arranged at the location of an opening (2) in the apparatus and which are rotatably supported and arranged to be driven in opposite directions of rotation, and also comprising a shear plate (11) which is arranged at the location of the opening in the apparatus, which covers the depletion rollers, and which is formed with elongate hair-entry apertures (12, 13, 14, 15, 16, 17) at the location of the depilation rollers, the elongate hair-entry apertures in the shear plate extending in the longitudinal direction of the depilation rollers and at least up to the ends of the depilation rollers.

4 Claims, 1 Drawing Sheet

DEPILATION APPARATUS

FIELD OF THE INVENTION

The invention relates to a depilation apparatus comprising at least one pair of depilation rollers which are arranged at the location of an opening in the apparatus, which are rotatably supported, which are rotatable in opposite directions, which cooperate circumferentially with one another and which perform a rotary movement which is directed into the interior of the apparatus, and comprising a shear plate arranged at the location of the opening in the apparatus, which shear plate covers the depilation rollers and is formed with elongate hair-entry apertures at the location of the depilation rollers.

BACKGROUND OF THE INVENTION

Such a depilation apparatus is disclosed in FR-PS 2,307,491. This known depilation apparatus comprises a shear plate which covers the depilation rollers and whose elongate hair-entry apertures extend exclusively in the area above the depilation rollers, said apertures being arranged adjacent one another and extending obliquely relative to the longitudinal direction of the depilation rollers. It has been found that a depilation apparatus having a shear plate of such a construction keeps the skin effectively away from the depilation rollers but does not provide a satisfactory depilation quality.

SUMMARY OF THE INVENTION

An object of the invention is to provide a depilation apparatus of the type defined in the opening sentence by means of which a very effective depilation can be achieved and which nevertheless keeps the skin effectively away from the depilation rollers.

According to the invention this is achieved in an apparatus wherein elongate hair-entry apertures formed in the shear plate extend in the longitudinal direction of the depilation rollers and at least up to the ends of the depilation rollers. In this way the skin is satisfactorily kept away from the depilation rollers and the shear plate has long hair-entry apertures which allow an effective hair entry to the depilation rollers in such a way that the end portions of the depilation rollers also partake in the depilation process.

It is preferred that one of the hair entry apertures in the shear plate directly exposes the area in which the depilation rollers of a pair cooperate circumferentially. This permits the entry of hairs exactly in the area where the depilation rollers are most likely to catch a hair, because the special arrangement of the hair-entry apertures ensures that this hair directly comes in the gripping area of the circumferentially cooperating depilation rollers.

It is also preferred that the shear plate is constructed to extend around at least one end portion of the depilation rollers and the hair-entry apertures formed in said plate extend into said area around the end portions of the depilation rollers. Such a trough-shaped construction of the shear plate ensures that at least one of the end portions of the depilation rollers can actively partake in the depilation process, which in practice is found to be very effective for a satisfactory depilation.

In this respect it is also preferred that at least one end portion of the depilation rollers is rotatably supported on the shear plate. In this way a very large area of the end portions of the depilation rollers can contribute to the depilation process.

DETAILED DESCRIPTION OF THE PREFERRED EMBODIMENTS

Figure 1:
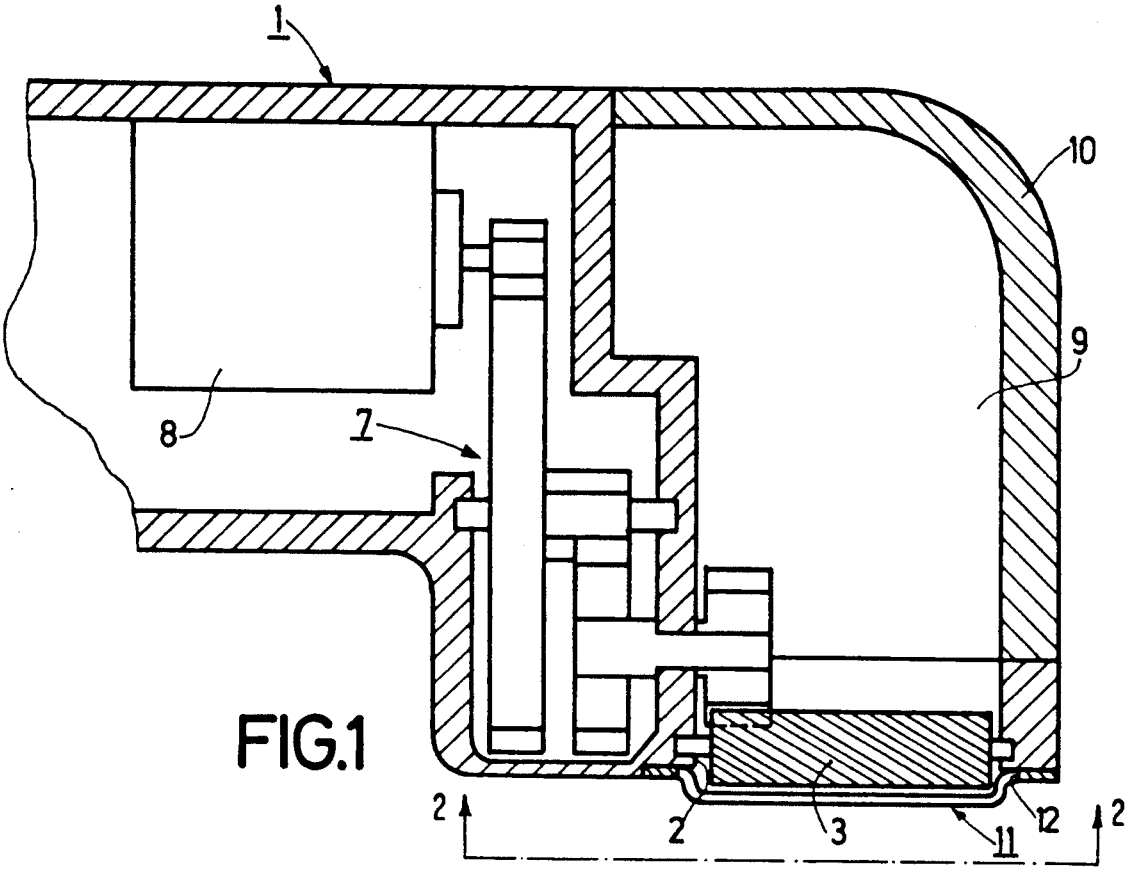
FIG. 1 is a longitudinal sectional view of a part of a depilation apparatus which comprises a shear plate and which for the extraction of hairs comprises two pairs of depilation rollers arranged to be rotatable in opposite directions.
Figure 2:
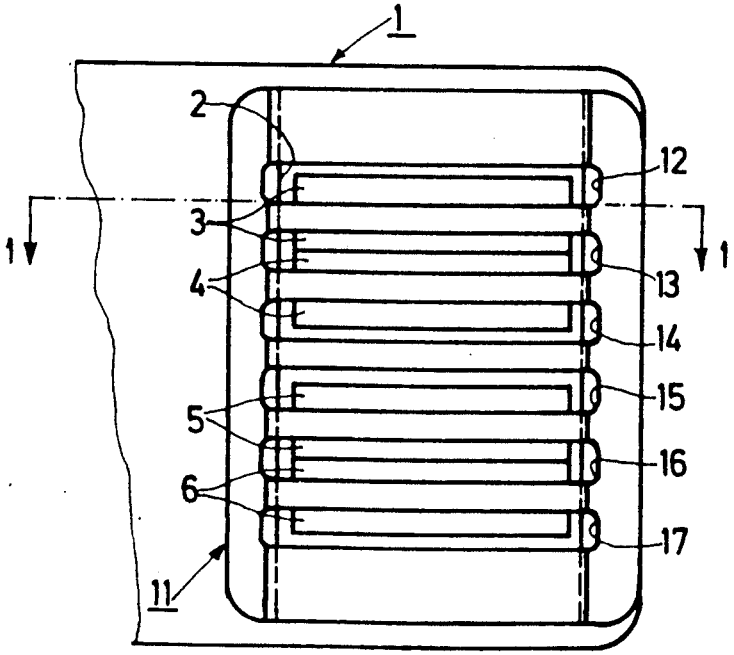
FIG. 2 shows the depilation apparatus in a plan view taken on the line II—II in FIG. 1.

In FIGS. 1 and 2 the housing 1 of a depilation apparatus has an opening 2 at the location of which two pairs of depilation rollers 3, 4 and 5, 6 are arranged to be rotatable. The depilation rollers of each pair 3, 4 and 5, 6 cooperate circumferentially with each other and are rotatable in opposite directions, the depilation rollers of each pair performing a rotary movement which is directed into the interior of the apparatus at the location where said rollers cooperate circumferentially with one another. The depilation rollers 3, 4, 5 and 6 may be circumferentially cross-sectional profiles with which they interengage during cooperation of the rollers. As is indicated for the depilation roller 3 of the pair 3, 4 in FIG. 1, one of the depilation rollers of each pair can be driven by a motor 8 via, for example, a multi-stage gear mechanism 7, the direction of rotation being selected in such a way that the depilation roller 3 performs a rotary movement which is directed into the interior of the apparatus at the location where it cooperates circumferentially with the depilation roller 4. As a result of the circumferential cooperation of the depilation roller 3 with the depilation roller 4 the depilation roller 4 is also driven. Thus, the depilation rollers of each pair are capable of gripping a hair which is & caught between them and of exerting a pulling force on this hair to extract it from its follicle. The depilation rollers then feed a hair thus extracted into an adjoining collecting chamber 9 of the depilation apparatus. For the purpose of cleaning, this collecting chamber 9 of the depilation apparatus may be closed, for example, by means of a cover 10 which is detachable from the apparatus housing 1.

It is found to be effective to provide such a depilation apparatus with a shear plate 11 which is arranged at the location of the opening 2 in the apparatus, which covers the depilation rollers 3, 4, 5 and 6, and which is formed with elongate hair-entry apertures at the location of the depilation rollers, in order to keep the skin away from the depilation rollers to prevent it from being caught between the depilation rollers of a pair, which would be very painful and which would also impair depilation. In order to obtain an effective construction of such a shear plate 11 the elongate hair-entry apertures in the shear plate extend in the longitudinal direction of the depilation rollers at least up to the ends of the depilation rollers, as is clearly illustrated in FIG. 2. In the present embodiment six of such hair-entry apertures are provided and bear the reference numerals 12, 13, 14, 15, 16 and 17. The hair-entry apertures extend over the whole length of the depilation rollers. As a result, the depilation rollers can actively pertake in depilation over their whole length without any interruption, i.e. at least up to the ends of the depilation rollers.

In especially preferred embodiments, one of the hair-entry apertures in the shear plate 11 directly exposes the area in which the depilation rollers of each pair 3, 4 and 5, 6 cooperate circumferentially. As can be seen in FIG. 2, this is the hair-entry aperture 13, which directly exposes the area in which the depilation rollers 3 and 4 cooperate circumferentially and the hair-entry aperture 16, which directly exposes the area in which the depilation rollers 5 and 6 cooperate circumferentially. The hairs can directly reach the gripping area of the depilation rollers of each pair 3, 4 and 5, 6 through these hair-entry apertures 13 and 16 respectively, so that they are gripped effectively by the depilation rollers and are extracted correctly. If hairs enter the other hair-entry apertures 12, 14, 15 and 17 which do not directly expose the area where the depilation rollers of a pair cooperate circumferentially, it is not unlikely that as a result of its rotary movement the nearest depilation roller also guides such hairs to the gripping area of the depilation rollers of the relevant pair, where they are also gripped by the circumferentially cooperating depilation rollers and are extracted. This applies in particular to longer hairs.

As can be seen, the shear plate 11 in the present embodiment is constructed to enclose both end portions of the depilation rollers and the hair-entry apertures in the shear plate extend into this area around the end portions of the depilation rollers. In this way it is achieved that the end portions of the depilation rollers can partake in the depilation process, which is found to be very advantageous for an effective depilation.

Figure 3:
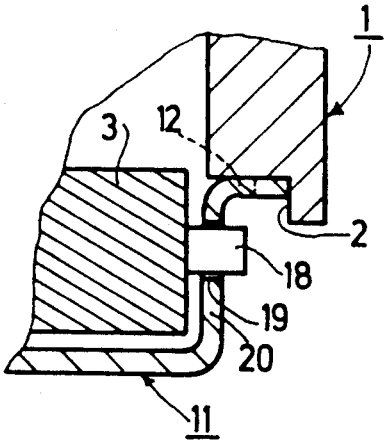
FIG. 3, in the same way as FIG. 1, shows a part of a depilation apparatus in which one of the end portions of the depilation rollers is rotatably supported in the shear plate.

In order to enhance the last-mentioned effect at least one of the end portions of the depilation rollers in the embodiment shown in FIG. 3 is rotatably supported in the shear plate 11 , as is illustrated here for the depilation roller 3 and in the present case this is achieved in that a journal 18 provided at the relevant end of the depilation roller 3 is passed ,through an opening 19 formed in the shear plate 11, which opening 19 is situated in an area 20 of the shear plate 11 where the shear plate 11 surrounds the relevant end portion of the depilation roller 3. In this way the shear plate 11 can extend beyond the center of the end surface of the depilation roller 3, enabling the hair-entry apertures in the shear plate 11, as is illustrated for the hair-entry aperture 12 in FIG. 3 to be also extended into the area 20 of the shear plate where it surrounds the end portion of the depilation roller, so that the hairs can readily reach the relevant end portion of the depilation roller. It is obvious that the end portions of the depilation rollers can be supported in the shear plate in other ways than shown for the embodiment in FIG. 3. For example the shear plate may be provided with cup-shaped supports for the journals at the ends of the depilation rollers. Moreover, the depilation rollers may be rotatably supported in the shear plate at both sides. In such a case the shear plate constitutes a support for the depilation rollers, which support may be detachable from or pivotable away from the apparatus in order to provide a simple cleaning possibility for the depilation rollers.

As will be apparent from the foregoing, a variety of modifications to the embodiments described above are possible without departing from the scope of the invention.

We claim:

1. A depilation apparatus for removing body hair comprising at least one pair of depilation rollers which are arranged at the location of an opening in the apparatus, which are rotatably supported, which are rotatable in opposite directions, which cooperate circumferentially with one another, and which perform a rotary movement which is directed into the interior of the apparatus at the location where said deposition rollers cooperate circumferentially; means for rotating said depilation rollers; and a shear plate arranged at the location of the opening in the apparatus, which shear plate covers the depilation rollers and is formed with a plurality of elongate hair-entry apertures at the location of the depilation rollers, wherein:

the shear plate is constructed to extend around at least one end portion of the depilation rollers; and the elongate hair-entry apertures formed in the shear plate extend in the longitudinal direction of the depilation rollers into an area around the end portions of the depilation rollers.

2. A depilation apparatus for removing body hair comprising at least one pair of depilation rollers which are arranged at the location of an opening in the apparatus, which are rotatably supported, which are rotatable in opposite directions, which operate circumferentially with one another, and which perform a rotary movement which is directed into the interior of the apparatus at the location where said depilation rollers cooperate circumferentially; means for rotating said depilation rollers; and a shear plate arranged at the location of the opening in the apparatus, which shear plate covers the depilation rollers and is formed with a plurality of elongate hair-entry apertures at the location of the depilation rollers, wherein:

the shear plate is constructed to extend around at least one end portion of the depilation rollers;

the elongate hair-entry apertures formed in the shear plate extend in the longitudinal direction of the depilation rollers into an area around the end portions of the depilation rollers; and one of the hair-entry apertures in the shear plate directly exposes an area in which the depilation rollers of a pair cooperate circumferentially.

3. A depilation apparatus for removing body hair comprising at least one pair of depilation rollers which are arranged at the location of an opening in the apparatus, which are rotatably supported, which are rotatable in opposite directions, which cooperate circumferentially with one another, and which perform a rotary movement which is directed into the interior of the apparatus at the location where said depilation rollers cooperate circumferentially; means for rotating said depilation rollers; and a shear plate arranged at the location of the opening in the apparatus, which shear plate covers the depilation rollers and is formed with a plurality of elongate hair-entry apertures at the location of the depilation rollers, wherein:

the shear plate is constructed to extend around at least one end portion of the depilation rollers, at least one end portion of at least one of the depilation rollers being rotatably supported on the shear plate; and the elongate hair-entry apertures formed in the shear plate extend in the longitudinal direction of the depilation rollers into an area around the end portions of the depilation rollers.

4. A depilation apparatus for removing body hair comprising at least one pair of depilation rollers which are arranged at the location of an opening in the apparatus, which are rotatably supported, which are rotatable in opposite directions, which cooperate circumferentially with one another and which perform a rotary movement which is directed into the interior of the apparatus at the location where said depilation rollers cooperate circumferentially; means for rotating said depilation rollers; and a shear plate arranged at the location of the opening in the apparatus, which shear plate covers the depilation rollers and is formed with a plurality of elongate hair-entry apertures at the location of the depilation rollers, wherein:

the shear plate is constructed to extend around at least one end portion of the depilation rollers, at least one end portion of at least one of the depilation rollers being rotatably supported on the shear plate;

the elongate hair-entry apertures formed in the shear plate extend in the longitudinal direction of the depilation rollers into an area around the end portions of the depilation rollers; and one of the hair-entry apertures in the shear plate directly exposes an area in which the depilation rollers of a pair cooperate circumferentially.

* * * * *